United States Patent [19]

Mowry

[11] Patent Number: 4,547,183

[45] Date of Patent: Oct. 15, 1985

[54] CORRUGATED BOX MACHINE

[75] Inventor: Donald E. Mowry, Norwalk, Ohio

[73] Assignee: Don Mowry Flexo Parts, Inc., Norwalk, Ohio

[21] Appl. No.: 442,611

[22] Filed: Nov. 18, 1982

[51] Int. Cl.[4] ..... B31B 1/58

[52] U.S. Cl. ..... 493/182; 493/423; 493/441

[58] Field of Search ..... 493/182, 180, 181, 177, 493/178, 397, 399, 423, 441, 424

[56] References Cited

PUBLICATIONS

Partial Manual for a Model-701 Flexo Folder-Gluer.

*Primary Examiner*—Leon Gilden

*Attorney, Agent, or Firm*—Emch, Schaffer, Schaub & Porcello Co.

[57] ABSTRACT

A corrugated box machine having improved delivery means is disclosed. A conveyor belt assembly works in combination with tensioning apparatus, a support bracket assembly and an idler guide assembly.

5 Claims, 12 Drawing Figures

CORRUGATED BOX MACHINE

BACKGROUND OF THE INVENTION

Corrugated boxes are typically produced in large machines which have several sections, each of which performs one or more steps in the mass production of the boxes. These sections often include an inking section, a gluing section, a folding section, a delivery section and a stacking section.

In operation, corrugated board is fed into the inking section of the corrugated box machine. Here the board is cut, printed and scored for folding. From the inking section the board travels into the gluing section where a bead of glue is applied along one edge of the board. The board then travels into the folding section where long rotating belts convey the board and cause the outer edges of the board to be folded inwardly along the scorelines. As the edges fold over, the glued edge is folded onto the unglued edge to form a seal. Once the board is glued, folded and sealed, it then passes into the delivery section which facilitates the transfer of the finished corrugated box from the folding section into the separate stacking section.

A common problem involved with the folding process is that the leading and trailing edges of the corrugated board become skewed. It is therefore an object of this invenion to provide a corrugated board conveying system which will produce a properly aligned corrugated box.

Another problem with present corrugated box machines involves the belts used for conveying the board material through the gluing and folding sections of the machine. As the belts become worn, they begin to stretch and slip on the rollers and drive pulleys. This is particularly true with the lower main drive belts. It is therefore an object of this invention to provide a corrugated board conveying system which will lessen the slippage of the belts about their respective rollers and drive pulleys.

Once the corrugated box emerges from the folding section, it passes into the delivery section. The delivery section of prior art machines consist of a pair of upper and lower kidney belt assemblies which are used to keep smaller boxes in alignment as they cross the void between the folding and stacking sections of the machine.

The reason for the void between the two sections is that the entrance to the stacking section contains two vertical spiral gears which contact the outer edges of the finished corrugated box and gradually lift the box up and out of the way of the next box exiting the folding section. If the spiral gear is too close to the folding section, longer boxes become bent because the leading edge of the box reaches the top of the spiral before the trailing edge is freed from the folding section. Consequently, upper and lower kidney belt assemblies are used to increase the distance between the two sections.

The upper kidney belt in the prior art machinery is pivotally mounted. Thus when small corrugated boxes are being run, the upper kidney belt can be positioned atop the lower kidney belt to guide the smaller boxes as they pass from the folding section into the stacking section. When larger boxes are being run, the upper kidney belt assembly is pivoted up and out of the way to prevent bending of the larger boxes.

The kidney belts are driven by long drive shafts. As a result, when an old or damaged belt has to be replaced, the entire drive shaft has to be pulled through the machine to replace the belt. This results in costly losses in money and operation time while repairs are being made. It is therefore an object of this invention to provide an improved box conveying system which alleviates the need for such kidney belt assemblies.

Finally, when very wide boxes are being run, they tend to sag under their own weight. This can cause jamming and also loosen the glue seal between the two folded edges of the box. It is therefore an object of this invention to provide a box conveying system with an improved and simplified box support means.

Other objects and advantages of the invention will become apparent as the invention is described hereinafter in detail and with reference to the accompanying drawings.

SUMMARY OF THE INVENTION

The present invention consists of an improved system for conveying corrugated board through a corrugated box machine. Corrugated board is conveyed through the folding section of the machine between two pairs of long continuous loop drive belts placed one on top of the other. The belt pairs, consisting of upper and lower belts, are driven by drive shafts, gearing and pulleys.

Due to the inherent characteristics of the belt material, the longer, lower belt tends to stretch in length. As a result, a pneumatic tensioner has been included to maintain the proper degree of tension in the lower belt.

The upper and lower drive belts are preferably driven by the same power source. The gearing for the drive belts is arranged such that the upper belt travels slightly faster than the lower belt. This tends to alleviate the problem of the boxes skewing as they emerge from the folding section.

The corrugated boxes emerging from the folding section enter the delivery section. Here both the upper and lower kidney belt assemblies have been replaced. The lower kidney belt is replaced by extending the lower main drive belt outwardly to include the area previously occupied by the lower kidney belt assembly. The upper kidney belt is replaced by a series of rollers which bridge the gap between the end of the upper main drive belt and the entrance to the stacking section of the machine.

Finally, a support is provided intermediate the drive belt assemblies of the folding section of the machine to keep the newly glued boxes from sagging and also to prevent the glued seam from separating.

DESCRIPTION OF THE PREFERRED EMBODIMENT

Figure 1:
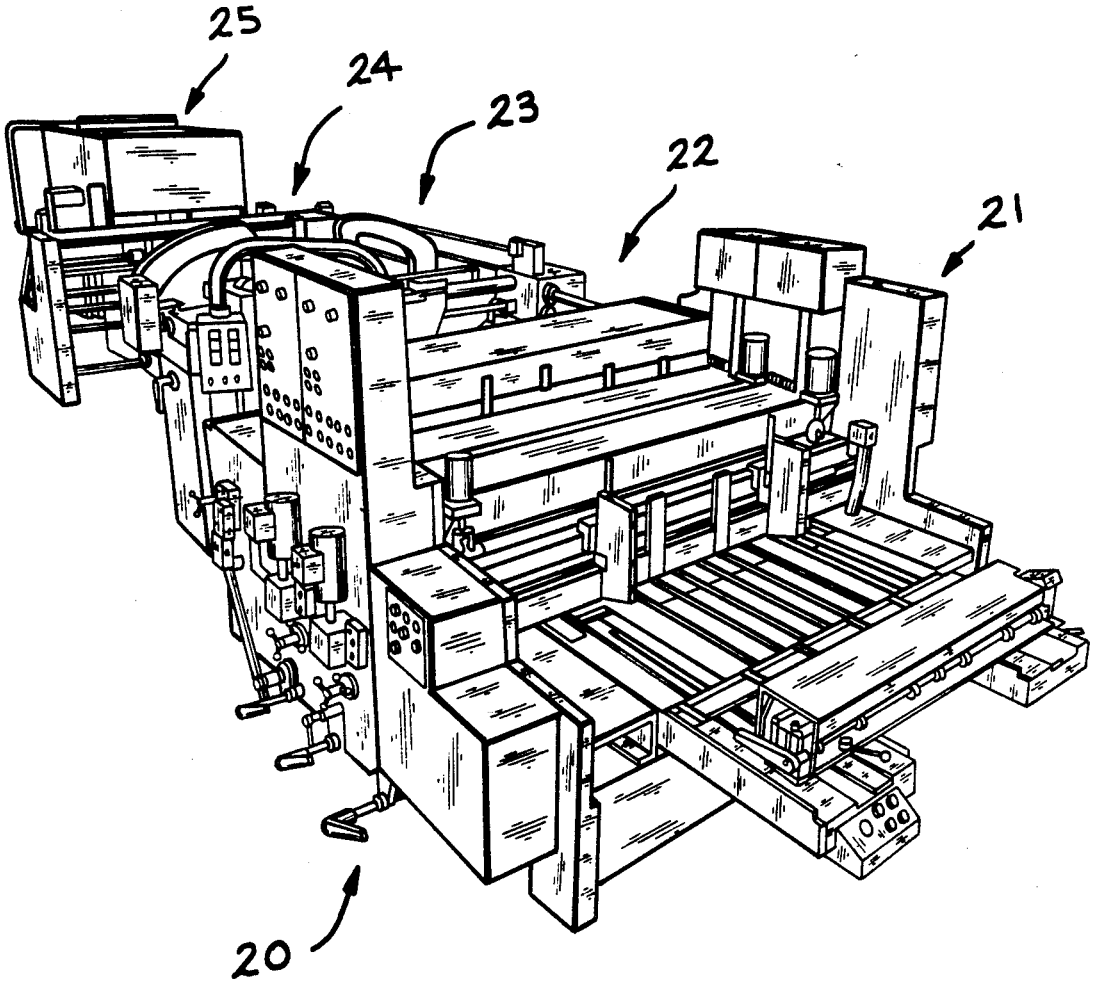
FIG. 1 is a perspective view of a corrugated box machine having inking, gluing, folding and delivery apparatus.

Referring now to FIG. 1, portions of a typical corrugated box machine 20 are generally depicted. They included an inking section 21, a gluing section 22, a folding section 23, a delivery section 24, and a stacking section 25. The present invention includes an improved means of conveying the corrugated board through the machine 20.

In operation, corrugated board stock is fed into the inking section 21. Here the corrugated board is printed, scored for folding and cut to form the box flaps. From here, the corrugated board travels into the gluing section 22 where a bead of glue is applied to one edge of the board. The board then travels into the folding section 23, where the outer edges are folded over on the scorelines and glued together thus forming a corrugated box. From the folding section 23, the box then passes into the delivery section 24 which transfers the box into the stacking section 25 of the machine 20.

Figure 5:
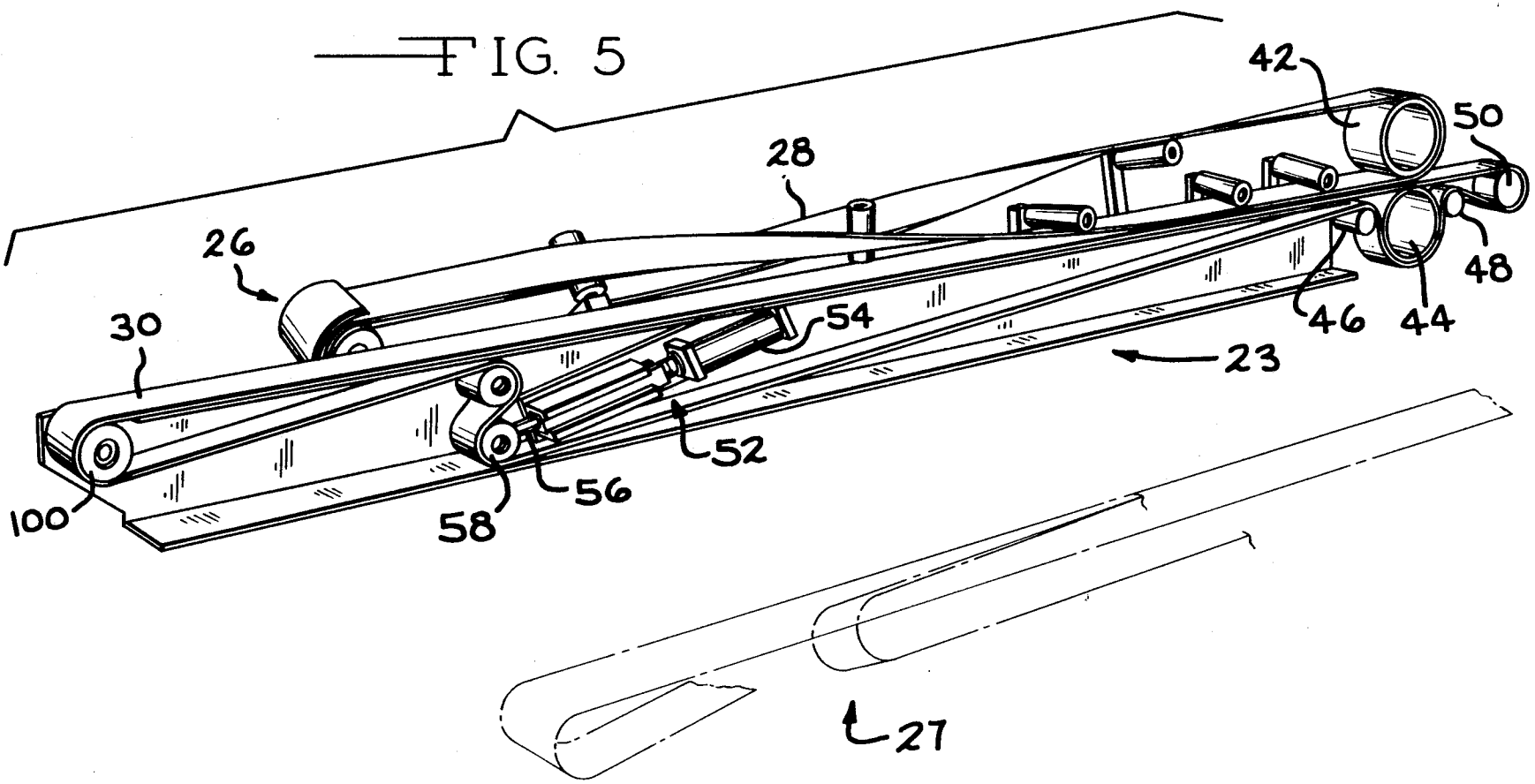
FIG. 5 is a partial perspective view of the belt system shown in FIG. 1.

The corrugated board is sent through the folding section 23 of the machine 20 by means of a pair of main drive belt assemblies 26 and 27 as shown in FIG. 5. The assemblies 26 and 27 are positioned on either side of the machine 20 and are laterally adjustable to grasp the outer edges of varying sizes of corrugated board stock.

Notice in FIG. 5 that assembly 27 is shown in phantom and only assembly 26 is shown in detail. This is because assemblies 26 and 27 are mirror images of one another. Thus, any references made to assembly 26 will be equally applicable to assembly 27.

Figure 2:
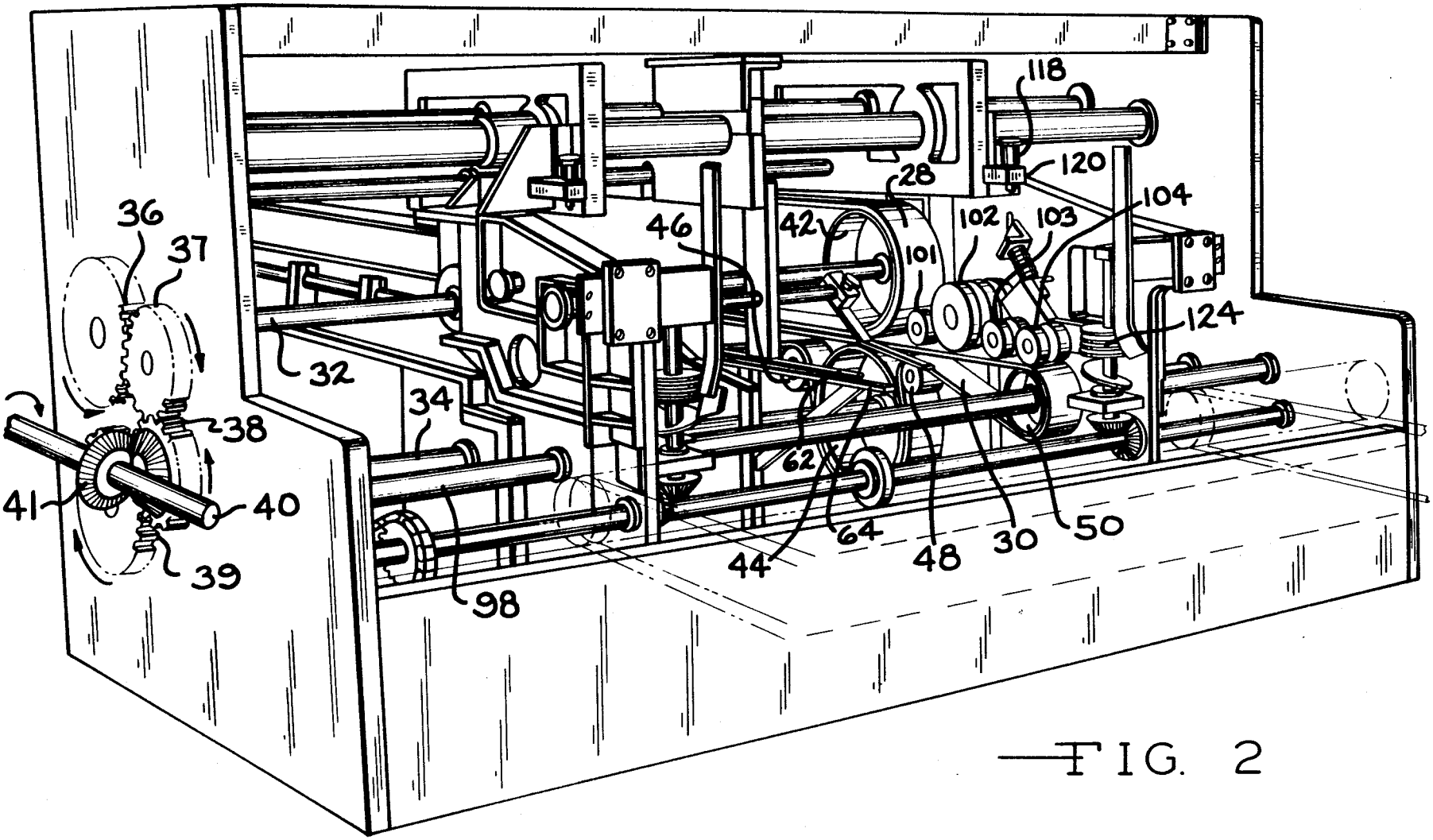
FIG. 2 is a perspective view of the exit side of the delivery portion of a corrugated box machine, according to the present invention.

The main drive belt assembly 26 consists of an upper main drive belt 28 and a lower main drive belt 30. As shown in FIG. 2, upper main drive belt 28 is driven by drive shaft 32 and lower main drive belt 30 is driven by drive shaft 34. These drive shafts 32 and 34 are in turn driven by a series of gears, 36, 37, 38 and 39 which are driven by a common output shaft 40 and gear 41 from a power source (not shown). The opposite ends of drive shafts 32 and 34 are connected to upper and lower drive pulleys 42 and 44 which drive the upper and lower main drive belts 28 and 30. Positioned to either side of the lower drive pulley 44 are two pinch rollers 46 and 48 and an auxiliary pulley 50 (See FIG. 3) which enable the lower main drive belt 30 to be extended beyond the upper main drive belt 28. Referring again to FIG. 5, a piece of corrugated board which has already been cut, printed, scored and glued, comes onto the top side of lower main drive belt 30. As the corrugated board progresses through the folding section 23, which is from left to right in FIG. 5, the upper main drive belt 28 gradually begins to engage the board from the underside and work the outer edges over upon themselves along the scorelines. Finally, the folded edges of the board travel between and are frictionally engaged by the upper and lower main drive belts 28 and 30 which carry the box through the remainder of the folding section 23 of the machine 20. The steps relating to the folding process are depicted sequentially in FIGS. 6, 7, 8 and 9.

Figure 10:
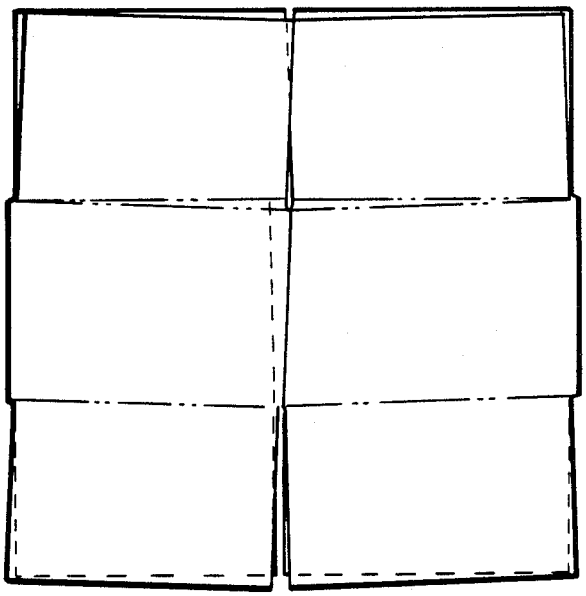
FIG. 10 is a diagrammatic top view of a box folded in a skewed fashion as sometimes resulted upon being folded on prior art equipment and the phantom lines represent a properly aligned and folded box produced according to the present invention.

A problem with prior art belt assemblies in prior art machines is that the outer edges of the corrugated board stock slip on the upper main drive belts 28 and 29 as the edges are folded over. As is shown in FIG. 10, this results in the box edges being skewed. In the present apparatus, the gearing of the upper main drive belts 28 and 29 is adjusted so the speed of the upper belts is slightly faster than the speed of the lower main drive belts 30 and 31. As a result, the slipping of the board edges is compensated for by the increased upper belt speed and consequently, the box emerges from the folding section 23 with even edges.

The problem of the lower main drive belt 30 slipping due to stretching is corrected by the use of a pneumatic tensioner mechanism 52. Referring to FIG. 5, the tensioner mechanism 52 consists of a cylinder 54 and a piston 56. The piston 56 is attached to a pair of rollers 58 and the rollers 58 engage the belt 30.

In operation the cylinder 54 applies a pressure of approximately 30 pounds per square inch to the belt 30 through the piston 56 and rollers 58. As the belt 30 stretches, the pressure in the cylinder 54 moves the piston 56 outwardly, thus maintaining the proper amount of tension on the belt 30 and preventing any slippage.

Another problem with prior art machines arises during the production of larger boxes. When larger boxes are being run, the distance between the main drive belt assemblies 26 and 27 is greater. As a result, boxes in the folding section 23 tend to sag in the middle which can cause jamming and separation of the newly glued seam. In the present apparatus, a support bracket 60 is provided intermediate the drive belt assemblies 26 and 27.

Figure 11:
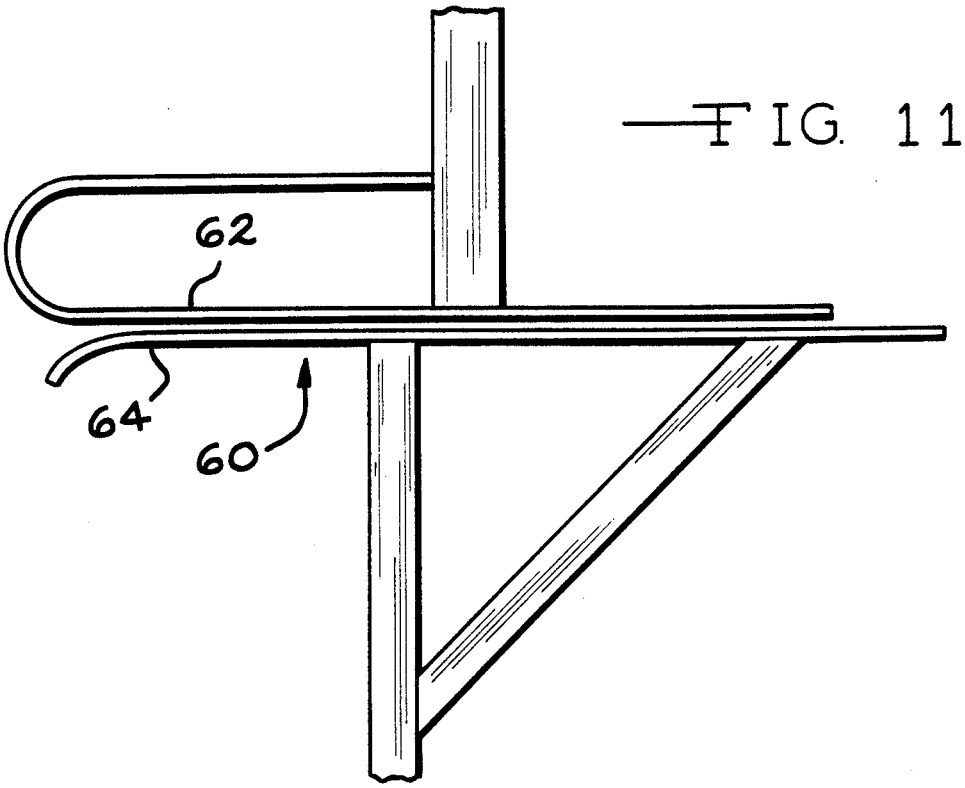
FIG. 11 is a side view of the support for the boxes.

Referring to FIGS. 2 and 11, the support 60 consists of a guide rod 62 positioned on top of a guide bar 64. The inlet ends of the rod 62 and bar 64 are curved outwardly to prevent jamming of the boxes as they enter the support. In addition, the rod 62 and bar 64 are spaced sufficiently apart so as to allow passage of the boxes while at the same time slightly compressing the glued seam to prevent its separation.

Figure 9:
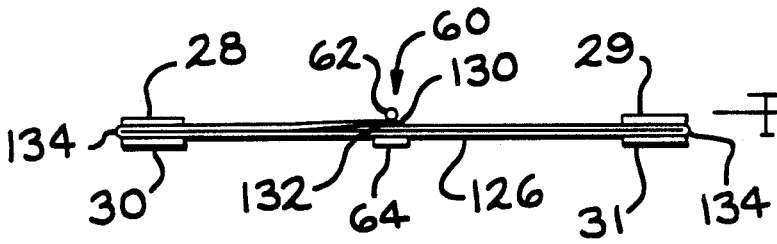
FIG. 9 is an end view of a folded and glued box.

FIG. 9 represents an end view of the box moving through the support rod 62 and bar 64. As can be seen from FIG. 9, the upper and lower main drive belts 28, 29, 30 and 31 grip the folded edges 134 of the box and move the box through the folding section 32. At the same time, the bar 64 and rod 62 support the center of the box and keep the newly glued edges 130 and 132 from separating.

Figure 12:
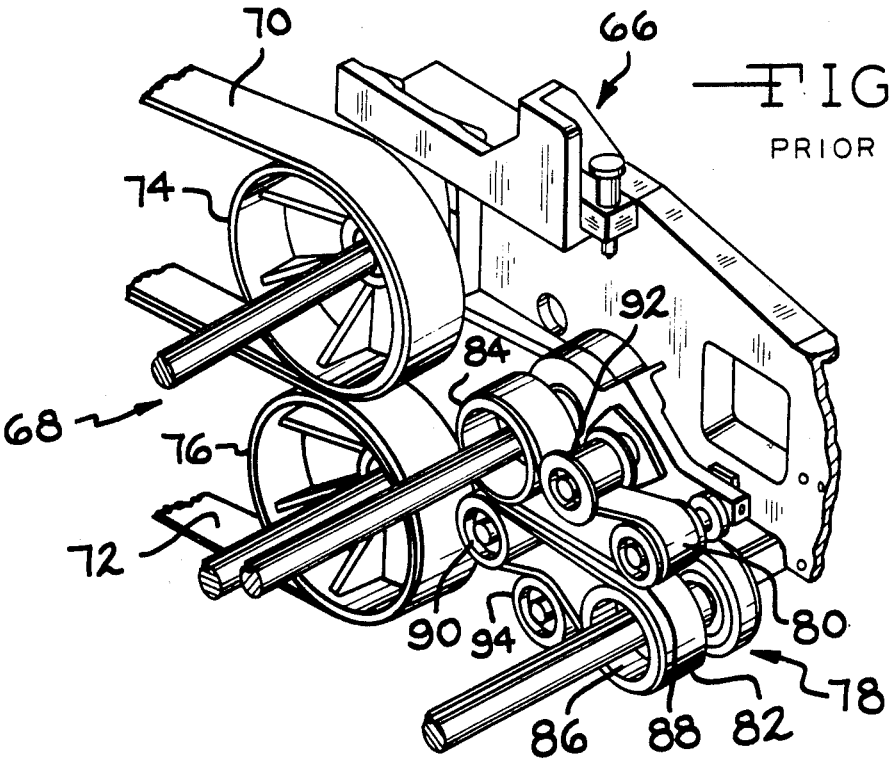
FIG. 12 PRIOR ART
FIG. 12 is a perspective view of a prior art dual kidney belt assembly on a typical prior art box machine.

Once the box emerges from the folding section 23, it passes into the delivery section 24. One type of prior art delivery section 66 is shown in FIG. 12. This delivery section 66 consists of a main drive belt assembly 68 having an upper belt 70 and a lower belt 72 which are driven by drive pulleys 74 and 76 respectively. Intermediate the main drive belt assembly 68 and the stacking portion of the machine (not shown) is an auxiliary kidney drive belt assembly 78.

The auxiliary kidney drive belt assembly 78 consists of upper and lower kidney belts 80 and 82 which are driven by auxiliary drive belt pulleys 84 and 86. Each of the belts 80 and 82 have non-driven pulleys 88 and 90 and tensioner pulleys 92 and 94.

In operation, the corrugated box emerges from between the upper belt 70 and the lower belt 72 of the main drive belt assembly 68 and travels toward the auxiliary kidney belt asembly 78. Upon reaching the auxiliary belt assembly 78 the corrugated box begins to pass between the two driven kidney belts 80 and 82. The kidney belt assembly 78 then guides the box into a rotating spiral gear (not shown), which lifts the exiting box so that the leading edge of the next exiting box does not run into the trailing edge of the previous box.

The present machine totally eliminates the use of these costly kidney belt assemblies 78. As a result, the previously mentioned problems of high maintenance costs and downtime are greatly reduced.

Figure 3:
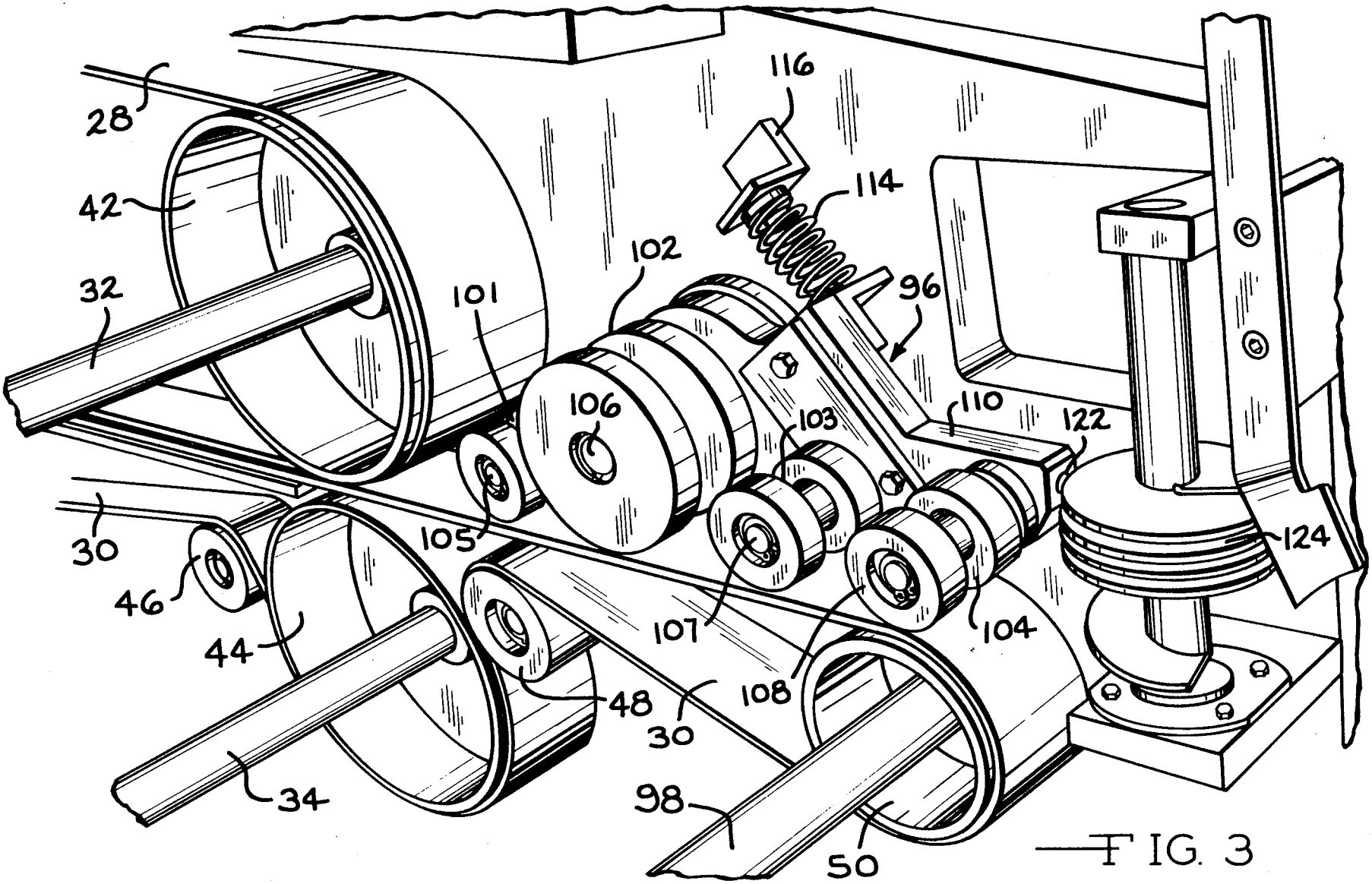
FIG. 3 is a close-up perspective view of the idler guide and belt assembly of FIG. 2, according to the present invention.

Turning now to FIG. 3, an idler guide assembly 96 replaces the upper kidney belt 80 and related pulleys 84, 88 and 92 of FIG. 12. The lower kidney belt 82 and related pulleys 86, 90 and 94 are eliminated. The lower main drive belt 30 is extended outwardly about shaft 98. The lower main drive belt 30 is extended around an auxiliary pulley 50 positioned on shaft 98 and two pinch rollers 46 and 48.

The lower portion of the belt 30 is positioned over the top of pinch roller 46. The belt is run between pinch roller 46 and the drive pulley 44, around the bottom of drive pulley 44, between pinch roller 48 and drive pulley 44, over pinch roller 48, around the bottom of auxiliary pulley 50 and thence to the rearward most pulley 100, shown in FIG. 5. In so doing, the lower main drive belt 30 occupies the space previously occupied by the prior art lower kidney belt 82.

The idler guide assembly 96 replaces the upper kidney belt 80 and consists of four roller pairs 101, 102, 103 and 104 which are mounted on shafts 105, 106, 107 and 108 respectively. The idler guide assembly 96 is positioned adjacent the upper drive pulley 42. Compared to the prior art machine, this reduces the amount of space in which the box is not being guided and driven from both above and below.

Figure 4:
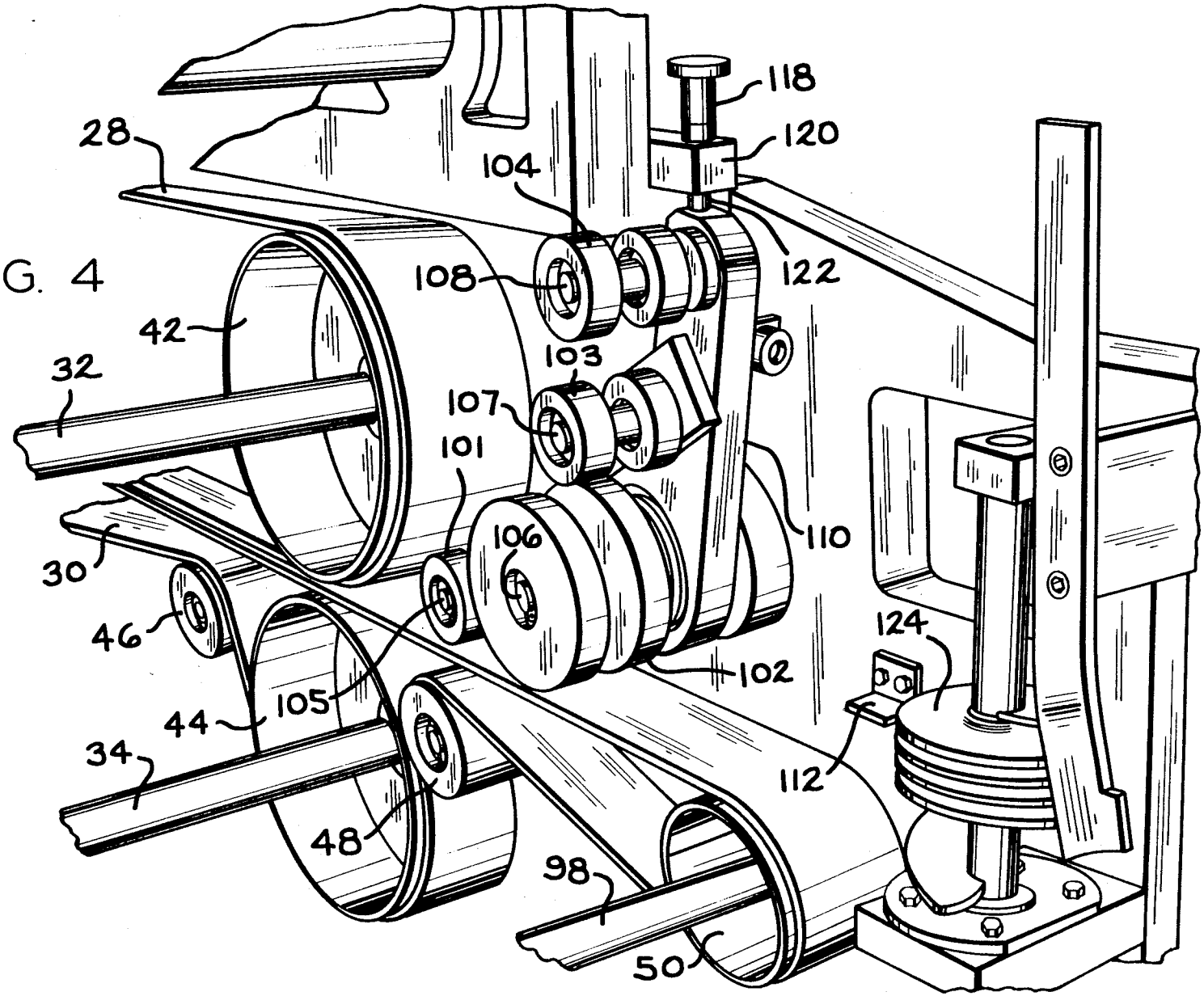
FIG. 4 is a view of the idler guide and belt assembly of FIG. 3 with the idler guide assembly in the up or disengaged position.

Shafts 107 and 108 of rollers 103 and 104 are in turn connected to a mounting bracket 110 which pivots about shaft 106 of roller 102. Consequently, rollers 101 and 102 are fixed while rollers 103 and 104 can either be positioned in the down position as shown in FIG. 3 or in the up position of FIG. 4, depending upon the size of the boxes being produced.

When rollers 103 and 104 are in the down position (FIG. 3) they are held against a support 112 (FIG. 4) by means of a compression spring 114 and bracket 116 which urge the idler guide assembly 96 in the direction of the corrugated box and the lower main drive belt 30.

When the idler guide assembly 96 is in the up position, as is commonly the case when running larger boxes, the spring 114 is swung out of the way and the rollers 103 and 104 are manually pivoted upward. To hold the idler guide assembly 96 in the up position, a spring loaded pin 118 is provided on the housing 120 and engages a detent 122 in the end of the mounting bracket 110.

Figure 6:
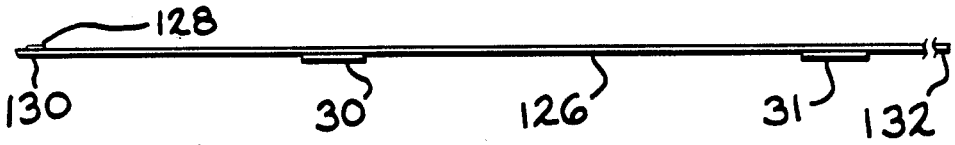
FIG. 6 is an end view of an unfolded box.
Figure 7:
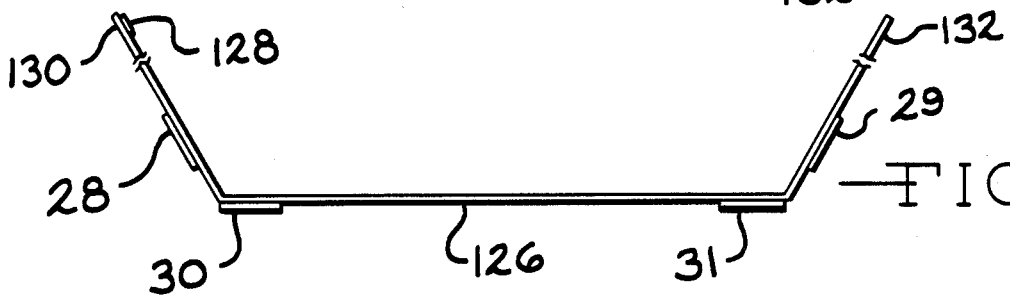
FIG. 7 is an end view of a box in the first stages of folding.
Figure 8:
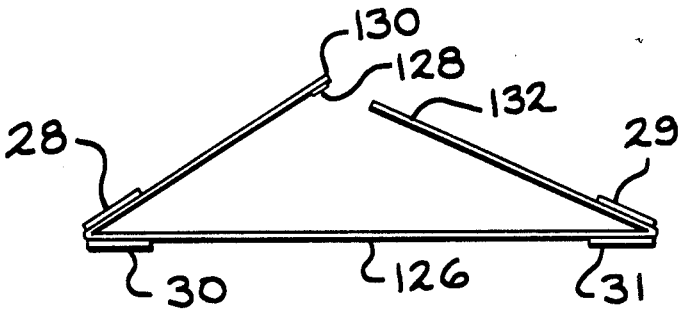
FIG. 8 is an end view of a box with the two folded edges just prior to overlapping.

In operation, the corrugated board 126 emerges from the gluing section as a flat piece with a bead of glue 128 on one of its outer edges 130, see FIG. 6. As the corrugated board 126 enters the folding section 23, only the lower main drive belts 30 and 31 contact the corrugated board 126. As the corrugated board 126 begins to contact the upper main belts 28 and 29, FIG. 7, the corrugated board 126 begins to fold along the previously formed score lines. Gradually, the upper main belts 28 and 29 work the sides 130 and 132 over upon themselves (FIG. 8) until they finally overlap and are glued, as shown in FIG. 9. At this point, the newly formed box passes into the guide 60 which prevents the glue joint from separating.

As the box begins to emerge from the folding section 23 it passes into the delivery section 24. It is at this point that the support 60, the idler guide assembly 96 and extended lower main drive belt 30 aid in the delivery of the exiting box from the folding section 23 to stacking section 25. As the box leaves the grip of the upper main belt 28 and while still being propelled by the lower main belt 30, the leading edge of the box comes into contact with the rollers 101, 102, 103 and 104 of the idler guide assembly 96. As the box continues to travel through the idler guide assembly 96, the leading and side edges of the box will engage the spiral gear 124 which serves to lift the box as it passes into the stacking section 25 so as to prevent the leading edge of the next box from running into the trailing edge of the previously exiting box. The box will continue to travel into the stacking section 25 due to the driving force of the extended lower main drive belt 30.

As was indicated previously, the idler guide assembly 96 can be positioned in the up or down position. Typically, the machine 20 is operated with the idler guide assembly 96 in the down position when small boxes are being run. This is because the length of some boxes are shorter than the distance between the end of the upper main drive belt 28 and the spiral lifting gear 124. When this is the case, the boxes in this area are free to move and can become displaced and jam the machine 20. By placing the idler guide assembly 96 in this void, the boxes can be held in place as they cross this area. In addition, by eliminating the old auxiliary kidney drive belt assembly 78 fewer jams occur because the rollers 101, 102, 103 and 104 of the idler guide assembly 96 are closer to the upper main drive belt 28 than the previous kidney belt assembly 78.

When larger boxes are being run, the idler guide assembly 96 is pivoted to the up position and not used. This is because with larger boxes the leading portion of the box travels to the top of the spiral lifting gear 124 before the rear of the box has passed from underneath the idler guide assembly 96. When this happens, the boxes become bent. This can be avoided by pivoting the idler guide assembly 96 up and out of the way when running the larger boxes, thus allowing a greater distance between the idler guide assembly 96 and the spiral gear 124.

Various modifications and changes may be made in the above-described preferred embodiment of the invention without departing from the spirit and scope of the following claims.

I claim:

1. In a corrugated box machine having a gluing apparatus, folding apparatus and delivery apparatus, said corrugated box machine including at least two conveyor belt assemblies, each assembly having an upper and lower conveyor belt, an upper and lower forward drive pulley, an upper and lower rearward pulley, an auxiliary pulley mounted forward of said lower forward drive pulley, a mounting bracket positioned above said auxiliary pulley, means for retaining said mounting bracket apart from said auxiliary pulley and elevator means for lifting the edge of a discharging corrugated box upwardly;

the invention comprising an improved delivery apparatus, said lower belt extending about said auxiliary pulley, an idler guide assembly pivotally mounted above said auxiliary pulley, a support means positioned intermediate said conveyor belt assemblies for supporting boxes being transported, force means for applying force to said lower conveyor belt, means for rotating said upper conveyor belt at a faster speed relative to said lower conveyor belt and bias means for applying a downward force to boxes passing between said idler guide assembly and said lower conveyor belt assembly.

2. In a corrugated box machine according to claim 1, said idler guide assembly including a plurality of spaced apart rollers.

3. In a corrugated box machine according to claim 1 wherein said idler guide assembly comprises a plurality of spaced apart rollers with at least one of such rollers being pivotal about another of such rollers.

4. In a corrugated box machine according to claim 1 wherein said support means comprises two parallel spaced apart elongated members in vertical juxtaposition, said members being curved away from each other at the receiving end.

5. In a corrugated box machine according to claim 1 wherein said force means for applying force to said lower conveyor belt comprises at least one roller engaging said lower conveyor belt and cyliner means for moving said roller.

* * * * *